US005186232A

United States Patent [19]

Zahner

[11] Patent Number: 5,186,232

[45] Date of Patent: Feb. 16, 1993

[54] ACCESSORY

[76] Inventor: David Zahner, 145 W. 78 St., New York, N.Y. 10024

[21] Appl. No.: 884,375

[22] Filed: May 18, 1992

[51] Int. Cl.[5] ..... A47H 1/00

[52] U.S. Cl. ..... 160/330; 160/390

[58] Field of Search ..... 160/330, 348, 350, 327, 160/354, 368.1, 390, 332, 370, DIG. 6, 38, 19, 39, 385, 386, 387, 388, 389

[56] References Cited

U.S. PATENT DOCUMENTS

| | | | |
|---|---|---|---|
| 2,093,269 | 9/1937 | Geller | 160/390 X |
| 3,148,726 | 9/1964 | Rothbart | 160/330 X |
| 3,372,729 | 3/1968 | Lindenmayer | 160/330 |
| 3,388,734 | 6/1968 | Silvestre | 160/348 |
| 3,434,525 | 3/1969 | Graff et al. | 160/388 |
| 4,202,059 | 5/1980 | Faragher | 160/330 X |
| 5,111,868 | 5/1992 | Sawaya | 160/330 |

*Primary Examiner*—David M. Purol
*Attorney, Agent, or Firm*—David Fink

[57] ABSTRACT

The present invention relates to an accessory suitable for mounting onto a rod to support a piece of material, and more particularly to an accessory which can take the form of a curtain, drape or portiere.

20 Claims, 1 Drawing Sheet

ACCESSORY

TECHNICAL FIELD

The present invention relates to an accessory suitable for mounting onto a rod to support a piece of material, and more particularly to an accessory which can take the form of a curtain, drape or portiere.

BACKGROUND OF THE INVENTION

There is a wide spread use of curtains and the like such as drapes and portieres by consumers and businesses for many aesthetic and practical reasons. In the home, it is convenient to separate one portion of a room from another using a curtain such as a shower curtain. Window curtains and drapes are also used to beautify homes as well as offices. It is also common to use a curtain type arrangement to separate a fireplace from the remainder of the room. Curtains are also used in manufacturing facilities to separate or define areas.

One of the common elements to curtains, drapes and the like is that they are usually mounted onto a rod and the intended use requires the mounting to allow movement of the curtain or at least portions of the curtain along the rod. Typical, the rod has a uniform cross section, usually circular.

In many situations, the curtains are not mounted directly on the rod. Instead, rings or clips are used to connect portions of a curtain to a rod. A typical shower curtain requires about a dozen clips and each clip must be manually attached to both the shower curtain and the rod. Furthermore, these clips are visible after the shower curtain has been mounted. Thus, a market has developed for clips which have some aesthetic appeal to compensate for the necessity have having exposed clips.

It is a common practice to have relatively small window drapes and the like include a sewn potion to define a tubular portion near one end of the material for mounting onto a rod. The rod must be removed from its mounting on the wall or window and threaded through the tubular portion.

Another arrangement for attaching curtains and the like to rods uses a plurality of clips which penetrate into the curtain like needles to attach to the curtain and another portion of each clip attaches either directly to the rod or to rings attached to the rod.

Accordingly, it can be seen that a need exists for a simple and effective accessory for attaching a curtain or the like to a rod while maintaining an aesthetic appearance. The present invention overcome the difficulty in the prior art of easily attaching a curtain or the like to a rod without the necessity of threading the rod or the use of support clips while maintaining an attractive appearance to the mounted curtain.

SUMMARY OF THE INVENTION

The present invention overcomes the disadvantages of the prior art problems by providing an accessory suitable for being easily mounted onto and detached from a rod without the necessity of threading the accessory onto and off the rod.

As used herein, the term "threading" refers to the act of moving a rod through an opening or a series of openings such as the action of threading a needle with thread.

As used herein, the terms "rod" or "rod-like" refers to an elongated object which can have a varying cross section, but preferably a uniform cross section and can be solid or hollow. More preferably, the cross section is circular. The rod can be made of wood, metal, plastic, a combination of any of the foregoing, or any other suitable material for supporting the accessory according to the invention.

The accessory can be a curtain, drape, portiere, or the like, or an intermediate segment between a rod and another portion such as a sheet of material or the like. Accordingly, the sheet of material would be attached to the accessory either permanently or detachably and the accessory would be mounted onto the rod.

As used herein, the term "sheet of material" broadly refers to a piece of material having relatively large dimensions in the directions of height and length as compared to its width. The sheet of material can be made of any substance consistent with the scope of the invention. The invention in a preferred embodiment relates to an accessory adapted for detachable mounting onto a rod-like member. The accessory includes a relatively flexible sheet of material having an end portion and mounting means integral with the material near the end portion both for mounting onto and detaching from the rod-like member without the necessity of threading the accessory onto and off the rod-like member. The mounting means includes two openings defined in the material and communicating with each other.

In another embodiment, the invention relates to the accessory further including reinforcing means integral with the material for each of the openings for inhibiting the tearing of the material and to maintain the integrity of the shape of the openings while engaged on the rod-like member.

In a further embodiment, the invention relates to an accessory in which the reinforcing means features a resilient material which can be deformed to enable the accessory to be mounted onto and detached from the rod-like member while maintaining the shape of the defined openings sufficiently to retain the accessory on the rod-like member when the accessory is moved on the rod-like member to draw the openings closer together and move them further apart from each other.

As used herein, the term "resilient" is used in its ordinary meaning to refer to a tendency of an object to return to its original shape after deformation. The resilient material can be made of a plastic, or a resin, or metal, or a combination thereof, or any other suitable material constructed and shaped to achieve the goal of being resilient for the practice of the invention.

In yet another embodiment, the invention relates to an accessory adapted for being detachably mounted onto first and second rod-like members. The accessory includes a flexible sheet of material having first and second opposing end portions. The accessory includes first and second mounting means integral with the material near the respective first and second end portions for mounting onto and for detaching from respective first and second rod-like members without the necessity of threading the accessory onto and off the rod-like members. The first mounting means includes first and second openings defined in the material and communicating with each other. The second mounting means includes third and fourth openings defined in the material and communicating with each other.

Other embodiments, features and advantages of the invention will become apparent upon reading the specification.

For a fuller understanding of the nature and objects of the invention, reference should be had to the following detailed description, taken in connection with the accompanying drawings in which.

DETAILED DESCRIPTION OF THE PREFERRED EMBODIMENTS

Figure 1:
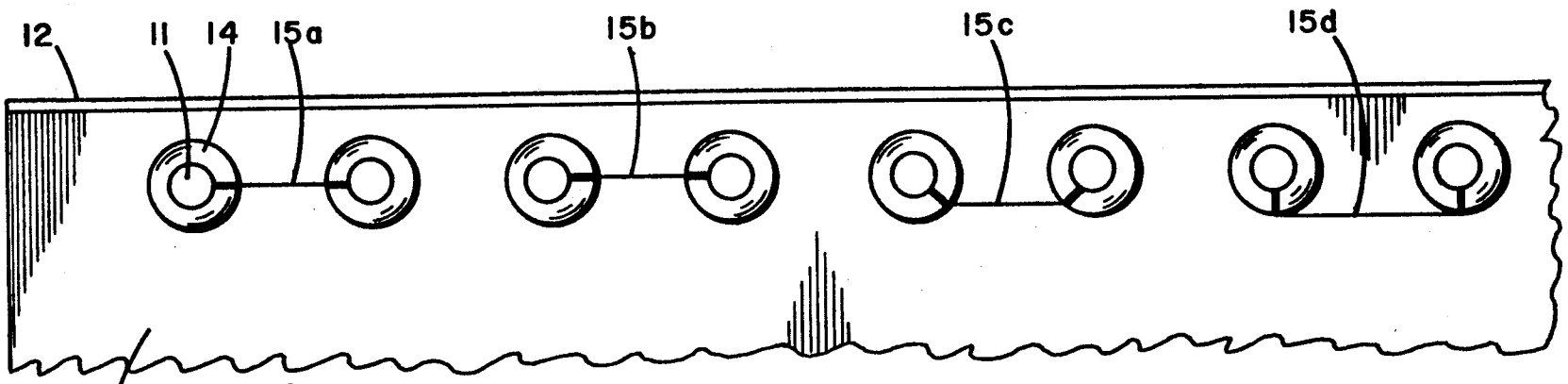
FIG. 1 is a front elevational view of a portion of the accessory according to the invention.
Figure 2:
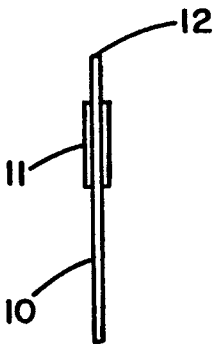
FIG. 2 is a side elevational view of the accessory shown in FIG. 1.

FIGS. 1 and 2 show a preferred embodiment of the accessory according to the invention. FIG. 1 shows a front elevational view of an accessory 9 according to the invention while FIG. 2 is a side elevational view. A portion of a sheet 10 preferable made of a flexible material is shown. The minimum amount of flexibility needed depends on the intended application. Typically, a drape or a shower curtain is highly flexible. Aside from such applications, the minimum flexibility will be evident from the discussion herein on the procedure for mounting and detaching the accessory.

The sheet 10 can be made of a plastic or resin such as commonly used for shower curtains, or a woven fabric or the like, or a non-woven fabric or the like, or a water resistant paper, or sheet metal, or woven metal strands or rods, or some other material suitable for the practice of the invention.

The advantage of using relatively inexpensive materials such as water resistant paper or the like is that the accessory 9 can be manufactured at a price enabling it to be sold as a disposable accessory. For example, the accessory 9 can be a disposable shower curtain. A disposable shower curtain could be used in many commercial situations such as hotels and motels and could also be used in institutional environments.

The openings 11 are defined in the sheet 10 and are spaced apart from each other. The openings 11 can have a variety of shapes and should have dimensions compatible with their intended mounting. A minimum of two openings 11 are needed to practice the invention and the operation of the accessory according to the invention utilizes pairs of openings 11 which cooperate with each other within the respective pairs.. Preferably, there are a plurality of pairs of openings to improve the support of the accessory 9 along its length.

Generally, the openings are located near an end portion of the sheet 10 such as near edge 12. The edge 12 can be reinforced in accordance with common practice for thin material sheets such as in the case of plastic sheets used for shower curtains. Reinforcement tends to inhibit tearing.

The spacing between openings 11 in a pair as well as the spacing between pairs of cooperating openings 11 will be obvious during the practice of the invention. Typically, a spacing of 10 to 20 cm. can be used for both. The spacing of the openings 11 from the edge 12 can also be selected to suit particular applications.

Figure 3:
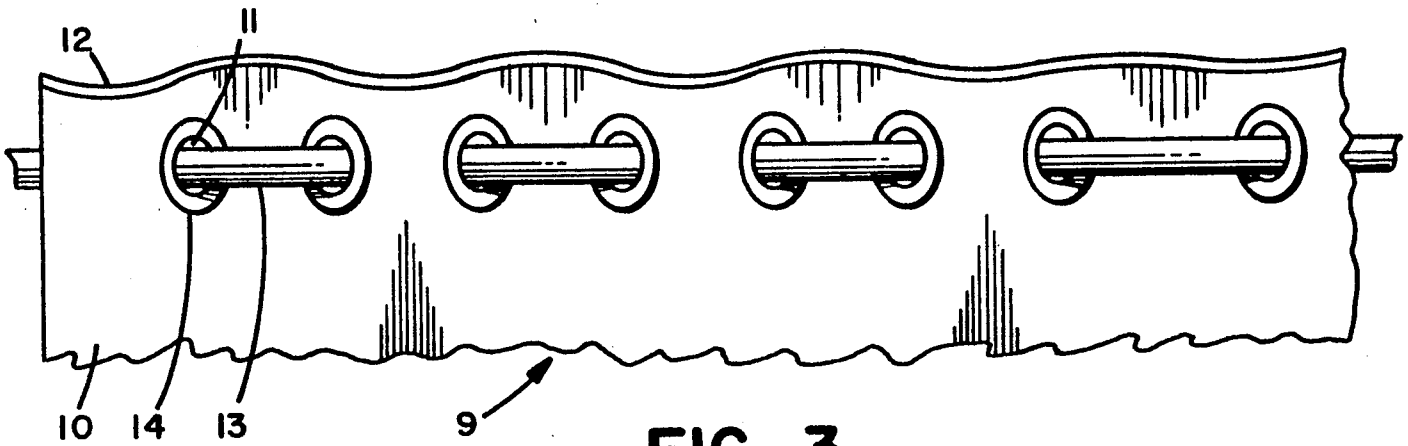
FIG. 3 is a front elevational view of the accessory shown in FIG. 1 mounted on a rod.

It is advantageous to select a spacing between the openings 11 and the edge 12 so that the portion of the sheet 10 above the openings 11 can be folded down after mounting the accessory 9 on a rod 13 as shown in FIG. 3, thereby substantially covering both the openings 11 and the rod 13. FIG. 3, however, shows the portion of the sheet 10 above the openings 11 in a relatively vertical plane in order to reveal the relationship between the openings 11 and the rod 13.

Each opening 11 is preferably substantially surrounded by a reinforcing means such as a ring 14 made of a resilient material to reinforce the opening 11 if the sheet 10 does not resist tearing and ripping satisfactorily. The use of rings 14 can also improve the movement of the mounted sheet 10 on the rod 13 as well as improve the engagement of the holes 11 with the rod 13. The rings 14 can be separate elements made integral with the sheet 10 or can be formed from the same material as sheet 10 during the formation of the sheet 10.

The rings 14 can have any shape compatible with the invention. Generally, the periphery of the openings 11 which actually engages the rod 13 may be defined by the rings 14 rather than the sheet 10. No distinction between these is made herein.

There is communication between the openings 11 in each pair of openings 11. As used herein, the term "communication" refers to the presence of an open path between two openings 11 in a pair. It is this communications between openings 11 in a pair which enables the engagement of the accessory 9 onto the rod 13. This communications is accomplished by respective cuts 15*a*, 15*b*, 15*c*, 15*d* through the respective pairs of rings 14 and the sheet 10 therebetween as shown in FIG. 1. The cuts 15*a*, 15*b* are shown as being the shortest path between openings 11, whereas the cuts 15*c*, 15*d* show other possible paths which might be used.

Mounting the accessory 9 onto the rod 13 is effortlessly accomplished in the following manner. The accessory 9 is held in front of the rod 13 with the cuts 15*a*, 15*b*, 15*c*, 15*d* generally aligned about parallel to the rod 13 and at about the same level. The accessory 9 is then moved towards the rod 13 until it is in contact with the rod 13, and then the rings 14 are deformed to provide engagement with the rod 13 by moving the portions of the rings 14 on opposite sides of the cuts 15*a*, 15*b*, 15*c*, 15*d* in opposite directions a distance at least equal to the diameter of the rod 13. At the same time, the portion of the sheet 10 between the pairs of openings 11 in each pair are pushed to the other side of the rod 13 by passing the rod 13 through the cuts 15*a*, 15*b*, 15*c*, 15*d*.

The accessory 9 shown in the FIGS. 1-3 could be an entire curtain or the like or part of separate curtain for mounting. In addition, the lower portion of the sheet 10 can have a similar arrangement of openings 11, rings 14 and cuts 15*a*, 15*b*, 15*c*, 15*d* so that both end portions can be mounted on respective rods 13.

There has been described a novel accessory. It is evident that those skilled in the art may now make numerous uses and modifications of and departures from the specific embodiments described herein without departing from the inventive concepts. Consequently, the invention is to be construed as embracing each and every feature and novel combination of features present or possessed by the accessory herein disclosed and limited solely by the spirit and scope of the appended claims.

What is claimed is:

1. An accessory adapted for being detachably mounted onto a rod-like member, said accessory comprising a flexible sheet of material having an end portion and mounting means integral with said material near the end portion both for mounting onto and detaching from said rod-like member without the necessity of threading said accessory onto and off said rod-like member, said mounting means comprising two openings defined in said material and communicating with each other.

2. The accessory as claimed in claim 1, wherein said mounting means comprises a plurality of pairs of openings defined in said material and the openings of each pair communicate with each other.

3. The accessory as claimed in claim 1, wherein said accessory is an integral portion of a curtain.

4. The accessory as claimed in claim 1, wherein said accessory is an integral portion of a drape.

5. The accessory as claimed in claim 1, wherein said accessory is an integral portion of a portiere.

6. The accessory as claimed in claim 1, wherein said accessory further comprises connecting means for connecting said accessory to another component to create a relatively larger unit suitable for mounting onto and detaching from said rod-like member.

7. The accessory as claimed in claim 1, wherein said accessory further comprises reinforcing means integral with said material for each of said openings for inhibiting the tearing of said material.

8. The accessory as claimed in claim 7, wherein said reinforcing means comprises a resilient material which can be deformed to enable said accessory to be mounted onto and detached from said rod-like member while maintaining the shape of the defined openings sufficiently to retain said accessory on said rod-like member when said accessory is moved on said rod-like member to draw said openings closer together and move them further apart from each other.

9. The accessory as claimed in claim 8, wherein said accessory is an integral part of a shower curtain, a window curtain, or a portiere.

10. An accessory adapted for being detachably mounted onto first and second rod-like members, said accessory comprising a flexible sheet of material having first and second opposing end portions, first mounting means integral with said material near the first end portion for mounting onto and for detaching from said first rod-like member without the necessity of threading said accessory onto and off said first rod-like member, said first mounting means comprising first and second openings defined in said material and communicating with each other, second mounting means integral with said material near said second end portion for mounting onto and for detaching from second rod-like member, said second mounting means comprising third and fourth openings defined in said material and communicating with each other.

11. The accessory as claimed in claim 10, wherein said accessory further comprises reinforcing means for each of said openings for inhibiting the tearing of said material.

12. The accessory as claimed in claim 11, wherein said reinforcing means comprises a resilient material which can be deformed for mounting onto and detaching from said rod-like members while substantially maintaining shape of the defined openings sufficiently to retain said accessory on said rod-like member when said accessory is moved on said rod-like member to draw said openings closer together and move them further apart from each other.

13. The accessory as claimed in claim 11, wherein said accessory is an integral part of a shower curtain, a window curtain, or a portiere.

14. An accessory adapted for being detachably mounted onto a rod-like member, said accessory comprising a flexible sheet of material selected from the group consisting plastic, woven fabric, unwoven fabric, water resistant paper and metal, said material having an end portion and mounting means integral with said material near the end portion both for mounting onto and detaching from said rod-like member without the necessity of threading said accessory onto and off said rod-like member, said mounting means comprising two openings defined in said material and communicating with each other.

15. The accessory as claimed in claim 14, wherein said accessory is an integral portion of a curtain.

16. The accessory as claimed in claim 14, wherein said accessory is an integral portion of a drape.

17. The accessory as claimed in claim 14, wherein said accessory is an integral portion of a portiere.

18. The accessory s claimed in claim 14, wherein said material is pleated.

19. The accessory as claimed in claim 14, wherein said accessory further comprises reinforcing means integral with said material for each of said openings for inhibiting the tearing of said material.

20. The accessory as claimed in claim 19, wherein said reinforcing means comprises a resilient material which can be deformed to enable said accessory to be mounted onto and detached from said rod-like member while maintaining the shape of the defined openings sufficiently to retain said accessory on said rod-like member when said accessory is moved on said rod-like member to draw said openings closer together and move them further apart from each other.

* * * * *